US011370600B1

(12) United States Patent
Pindor et al.

(10) Patent No.: US 11,370,600 B1
(45) Date of Patent: Jun. 28, 2022

(54) SPRAY CAN ACTUATOR

(71) Applicants: Randy M. Pindor, Brecksville, OH (US); Theodore Bradley, North Ridgeville, OH (US); Gregory L. Skillicorn, Akron, OH (US)

(72) Inventors: Randy M. Pindor, Brecksville, OH (US); Theodore Bradley, North Ridgeville, OH (US); Gregory L. Skillicorn, Akron, OH (US)

(73) Assignee: B'LASTER LLC., Valley View, OH (US)

( * ) Notice: Subject to any disclaimer, the term of this patent is extended or adjusted under 35 U.S.C. 154(b) by 0 days.

(21) Appl. No.: 16/593,557

(22) Filed: Oct. 4, 2019

Related U.S. Application Data

(63) Continuation-in-part of application No. 16/138,576, filed on Sep. 21, 2018, now Pat. No. 10,464,736, and a continuation-in-part of application No. 29/664,157, filed on Sep. 21, 2018, now Pat. No. Des. 907,491.

(60) Provisional application No. 62/817,888, filed on Mar. 13, 2019.

(51) Int. Cl.

| | |
|---|---|
| ***B65D 83/20*** | (2006.01) |
| ***B65D 83/30*** | (2006.01) |
| ***B05B 1/16*** | (2006.01) |
| ***B05B 11/00*** | (2006.01) |
| ***B05B 15/652*** | (2018.01) |
| *B65D 83/56* | (2006.01) |

(52) U.S. Cl.
CPC ..... *B65D 83/303* (2013.01); *B05B 1/1645* (2013.01); *B05B 11/0094* (2013.01); *B05B 15/652* (2018.02); *B65D 83/206* (2013.01); *B65D 83/56* (2013.01)

(58) Field of Classification Search
CPC .... B65D 83/303; B65D 83/206; B65D 83/56; B05B 11/0094; B05B 15/652; B05B 1/1645
See application file for complete search history.

(56) References Cited

U.S. PATENT DOCUMENTS

| | | | | |
|---|---|---|---|---|
| 2,887,273 A * | 5/1959 | Anderson | B65D 83/206 239/337 |
| 3,083,872 A | 4/1963 | Meshberg | |
| 3,116,856 A * | 1/1964 | Prussin | B65D 83/303 222/402.24 |
| 3,428,225 A * | 2/1969 | Spencer | B65D 83/34 222/402.17 |
| 3,703,994 A * | 11/1972 | Nigro | B65D 83/20 239/397 |

(Continued)

*Primary Examiner* — Frederick C Nicolas

(57) ABSTRACT

An adjustable actuator for a spray can. The actuator includes a housing for attachment to an aerosol can covering a stem valve. A finger operating button structure is engaged with the housing for engaging the stem valve. A rotary two-way diverter valve is supported within the housing and rotatably engaged with the finger operating button structure. In a spray position/straw down, the two-way diverter valve directs spray through a first direct spray nozzle. In a second straw position/straw up, the diverter valve is rotated to engage a straw spray passage of the diverter valve in fluid communication with a spray tip and engaged straw. A sliding tab member engaged between and on the housing and button structure is used to adjust the desired amount of fluid flow.

18 Claims, 15 Drawing Sheets

(56) References Cited

U.S. PATENT DOCUMENTS

| | | | | | |
|---|---|---|---|---|---|
| 3,711,030 | A * | 1/1973 | Jones | B65D 83/205 239/397 |
| 3,795,366 | A * | 3/1974 | McGhie | B65D 83/7532 239/397 |
| 3,863,816 | A * | 2/1975 | Focht | B65D 83/20 222/402.17 |
| 3,951,314 | A * | 4/1976 | Toro | B65D 83/34 222/402.17 |
| 4,690,312 | A | 9/1987 | Crapser | |
| 5,154,323 | A | 10/1992 | Query et al. | |
| D358,989 | S | 6/1995 | Woods | |
| D371,738 | S | 7/1996 | Lamb | |
| D380,384 | S | 7/1997 | Ferrara | |
| 5,971,230 | A * | 10/1999 | Tanaka | B65D 83/44 222/402.11 |
| 6,105,882 | A | 8/2000 | Woltjen | |
| 6,293,436 | B2 | 9/2001 | Faughnder et al. | |
| D476,558 | S | 7/2003 | Cho | |
| 6,796,464 | B1 | 9/2004 | Tung | |
| 7,070,072 | B2 | 7/2006 | Bonham | |
| D536,970 | S | 2/2007 | Shannan et al. | |
| 7,249,692 | B2 | 7/2007 | Walters | |
| D587,576 | S | 3/2009 | Miller | |
| D659,534 | S | 5/2012 | Taylor | |
| 8,276,832 | B2 * | 10/2012 | Nelson | B65D 83/206 239/391 |
| 8,353,465 | B2 | 1/2013 | Tryon | |
| 8,528,837 | B2 * | 9/2013 | Kwasny | B05B 1/3026 239/337 |
| D691,040 | S | 10/2013 | Wade et al. | |
| 8,580,349 | B1 * | 11/2013 | Kordosh | B65D 83/752 427/421.1 |
| D710,697 | S | 8/2014 | Lind | |
| D723,368 | S | 3/2015 | Checklin et al. | |
| D734,151 | S | 7/2015 | Herbst | |
| 9,126,212 | B2 * | 9/2015 | Pirshafiey | B05B 1/12 |
| D746,135 | S | 12/2015 | Lind | |
| 9,248,457 | B2 | 2/2016 | Hanson | |
| 9,352,896 | B2 * | 5/2016 | Deutsch | B05B 14/00 |
| 9,944,454 | B2 * | 4/2018 | Haage | B65D 83/205 |
| 10,065,791 | B1 | 9/2018 | Charles | |
| 10,464,736 | B1 | 11/2019 | Pindor | |
| 10,589,920 | B2 * | 3/2020 | Fore | B65D 83/48 |
| D907,491 | S * | 1/2021 | Pindor | D9/448 |
| 2002/0053579 | A1 | 5/2002 | Baumgart | |
| 2004/0164105 | A1 | 8/2004 | Stern | |
| 2005/0173465 | A1 | 8/2005 | Roden | |
| 2017/0203908 | A1 | 7/2017 | Sater et al. | |
| 2019/0077580 | A1 | 3/2019 | Starzman | |
| 2019/0202624 | A1 * | 7/2019 | Andrews | B65D 83/303 |

* cited by examiner

SECTION D-D

SECTION A-A

SECTION A-A

SPRAY CAN ACTUATOR

CROSS REFERENCE TO RELATED APPLICATIONS

This application claims priority to and the benefit of pending U.S. patent application Ser. No. 16/138,576 filed Sep. 21, 2018, pending U.S. patent application Ser. No. 29/664,157 filed Sep. 21, 2018 and U.S. Patent Application No. 62/817,888 filed Mar. 13, 2019, the entire contents of each of which is incorporated herein by reference.

FIELD OF INVENTION

The application relates to an actuator for a spray can having a rotary two-way diverter valve with a straw, and specifically to an adjustable rotary two-way diverter valve with a direct spray nozzle and an adjustable straw for directing a desired spray or drip to a desired location.

BACKGROUND

Adjustable actuators for aerosol spray cans have become desirable to consumers for their aerosol products. Historically, and today, spray can actuators typically include a single finger operated spray button mounted on the aerosol can discharge valve. For certain consumer aerosol products, such as chemical penetrants, lubricants and rust inhibitors, for example, consumers desire an actuator which provides both a direct spray, stream or drip, and the ability to apply the product to a precise location from a further distance and perhaps within a somewhat obscured location. Using a removable, stand-alone straw in connection with the spray button enabled direct product application from a distance, but storage of the straw for later applications and use was problematic, often resulting in the loss of the straw. Some improvements have been provided, as set forth in U.S. Pat. Nos. 9,352,896, D536,970 and D723,368. However, additional improvements to provide still further aerosol spray application alternatives are desired.

SUMMARY

An improved actuator for an aerosol spray can is provided which has a housing with an adjustable dispensing button and a rotary two-way diverter valve with a nozzle for providing a direct spray, such as an adjustable conical fan spray pattern in a first position, and a second position for using a removable straw to provide an adjustable drip application to a remote location. Adjustment to the volume of desired fluid flow from the spray can is made by sliding or moving a sliding tab member engaged along mating teeth along the housing and with and between the dispensing button and the housing.

The improved actuator housing is adapted for attachment on the top of an aerosol can covering the aerosol can discharge valve or valve stem. The housing includes mounting legs forming an opening for rotating engagement with the two-way rotary diverter valve having integral boss axles mounted within axle openings formed in mounting legs of a finger operating dispensing button structure. The finger operating dispensing button structure is slidably engaged within the housing for finger operation of a button by a user to depress the spray can discharge valve. The sliding tab includes a ramp surface for engagement with a ramp cut-out on the finger operating dispensing button structure for adjusting the amount the finger operating dispending button structure may be depressed. Adjusting teeth and fluid volume indicia are provided on a surface of the housing for engagement by mating teeth on the sliding tab member. As the sliding tab member is moved along the teeth of the housing toward the high fluid volume indicia, a higher volume of fluid will be provided upon depression of the dispensing button. As the sliding tab member is moved along the teeth of the housing toward the lower fluid volume indicia, a lower volume of fluid will be provided upon depression of the dispensing button.

The finger operating structure includes a nozzle passage extending transversely from a central vertical conically shaped passage engaging the valve stem. A nozzle end of the nozzle passage engages the rotary diverter valve, which is captured within the button structure and the housing, at a gasket seal.

In operation, the diverter valve may be rotated between a full spray position/straw down, to a straw position/straw up. Rotation of the two-way diverter valve may be operated into and out of the full spray position and straw position with one hand or finger. The external surface of the diverter valve is preferably provided with features, such as a textured or indented surfaces such as grooves, or more protruding features such as ribs or raised boss portions ("nibs"), since such features assist with overcoming the amount of finger force required to rotate the diverter valve while maintaining a seal, provided by a gasket seal, between the diverter valve and the dispensing button structure. In the full spray position/straw down, finger operation to depress the dispensing button structure, causes fluid to exit the can via the valve stem, through the central vertical conical passage and nozzle passage within the button structure, past the gasket into a nozzle passage of the diverter valve.

In the straw up position or straw spray position/straw up, the two-way diverter valve is first rotated upward, so that the nozzle end of the nozzle passage of the finger operating button structure, engages the diverter valve at an alternate straw nozzle passage within the diverter valve, offset from a central axis of the valve. In straw spray position/straw up, fluid exits the can via the valve stem upon depression of the dispensing button structure, through the central vertical conical passage and nozzle passage within the button structure, past the gasket into a straw spray passage of the diverter valve in fluid communication with the rotary spray tip and straw. Adjustment of the amount of fluid desired from the straw is provided by sliding the sliding tab along mating teeth engaged with the housing toward the desired higher or lower indicia.

DETAILED DESCRIPTION

Figure 1:
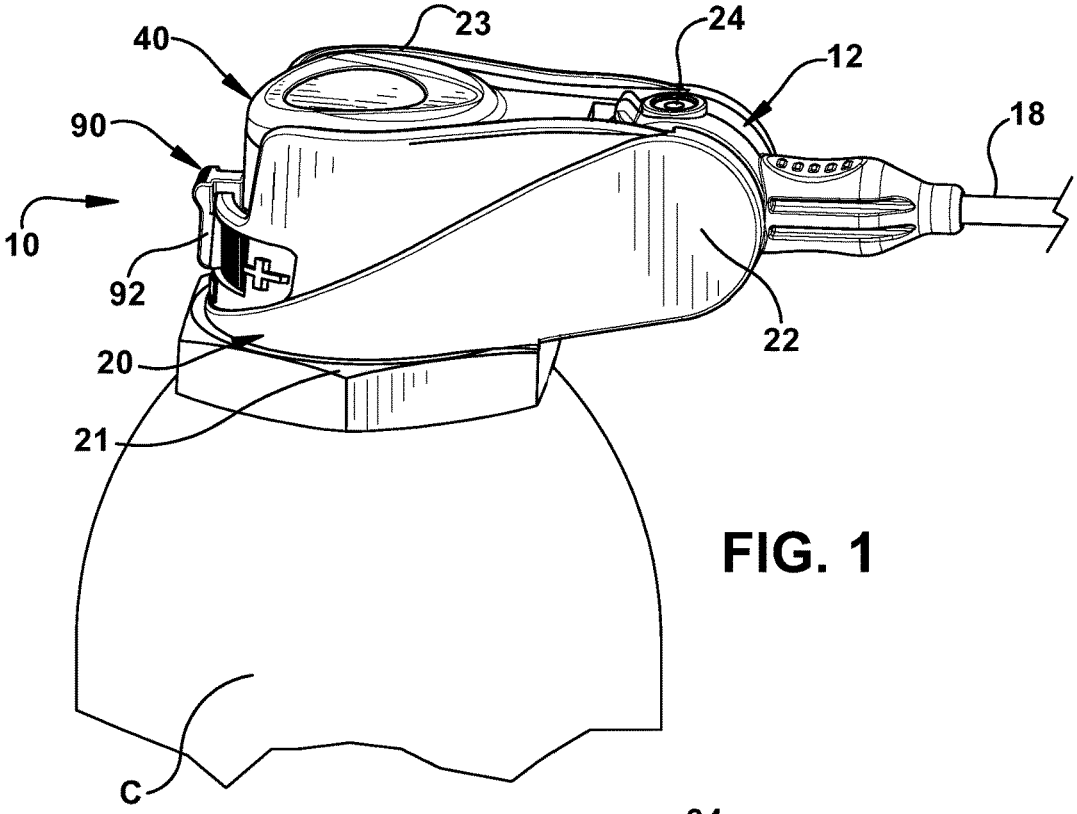
FIG. 1 is a right side perspective view of the spray can actuator of this application in straw up position.

FIGS. 1 to 10 show the improved actuator 10 for an aerosol spray can C of the present application. The actuator 10 includes a housing 20 for attachment to a spray can C covering a spray can stem valve V, a finger operating button structure 40 and a one piece rotary diverter valve 20. As best seen in FIGS. 21 to 26, the one piece rotary diverter valve is a two-way diverter valve 12. The two-way diverter valve 12 is a one-piece design providing a straw up position for spraying fluid through a straw or feeder extension tube from the spray can, and a straw down position for providing a direct nozzle spray. In both positions, an adjustable fluid flow from the spray can is provided. Providing an adjustable volume enables varying the spray from between a full spray, to drops, or an off position.

Figure 36:
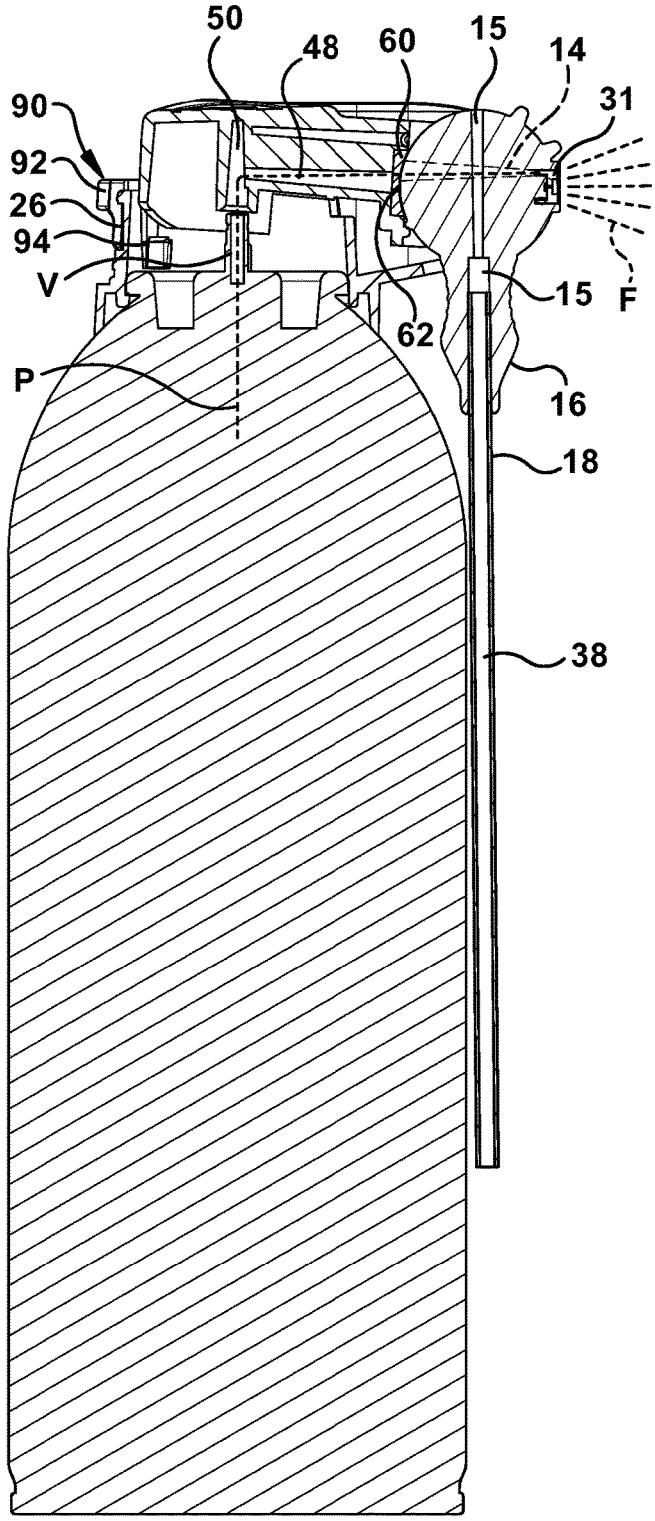
FIG. 36 is a cutaway side view of the spray can actuator of FIG. 35 taken along the line A-A.

The diverter valve 12 has a nozzle 14 for providing direct spray through an exit nozzle 37, such as a conical fan spray pattern F, as shown in FIG. 36, and a second straw nozzle 15 for communication with a spray tip 16. The nozzles 14, 15 are positioned transverse with respect to one another, and each is positioned for communication with a spray tip 37, 16 formed in the two-way diverter valve. The tip 16 is adapted for engagement by a removable straw 18, preferably a flexible straw to enable a spray of liquid or fluid to be directed through the straw 18.

Adjustment of the amount of desired fluid flow F from the spray can C, from either the straw 18 or the direct spray nozzle 14, is provided by movement of a sliding tab member 90 engaged with and supported for sliding movement on a ramp cut-out 41 in the button structure 40. The sliding tab member 90 includes teeth 96 which are engaged with and supported on grooves 26 formed on an external surface of the housing 10, and a ramp engaging surface 94 for engagement with the ramp cut-out 41 in the button structure. A finger surface 92 on the sliding tab member 90 enables a user to slidably engage the member along the teeth 96 mating within the housing grooves 26, which in turn moves the ramp engaging surface 94 engaged with the ramp cut-out 41, to enable selection of the desired volume of liquid to be dispensed from the spray can based upon the position of the sliding tab member with respect to the button structure.

Figure 6:
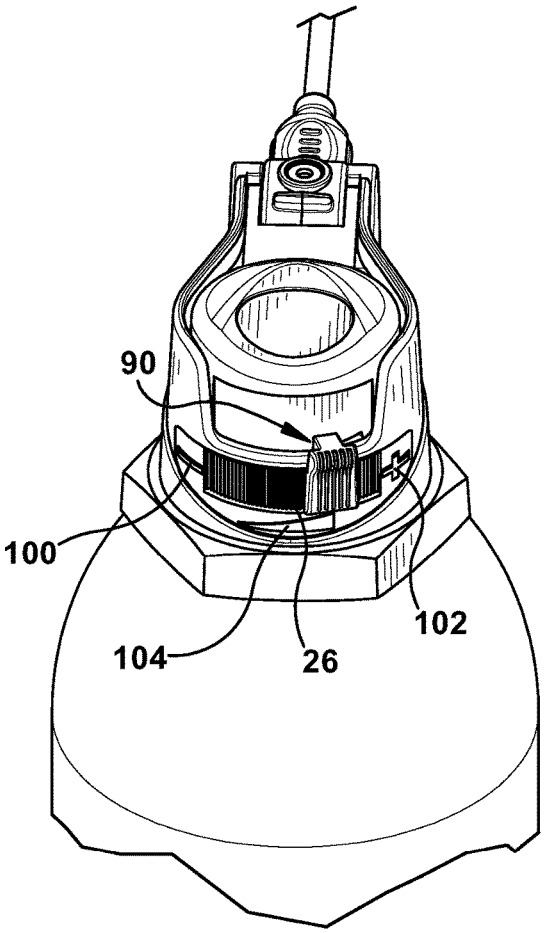
FIG. 6 is a top rear perspective view of the spray can actuator of FIG. 3.
Figure 7:
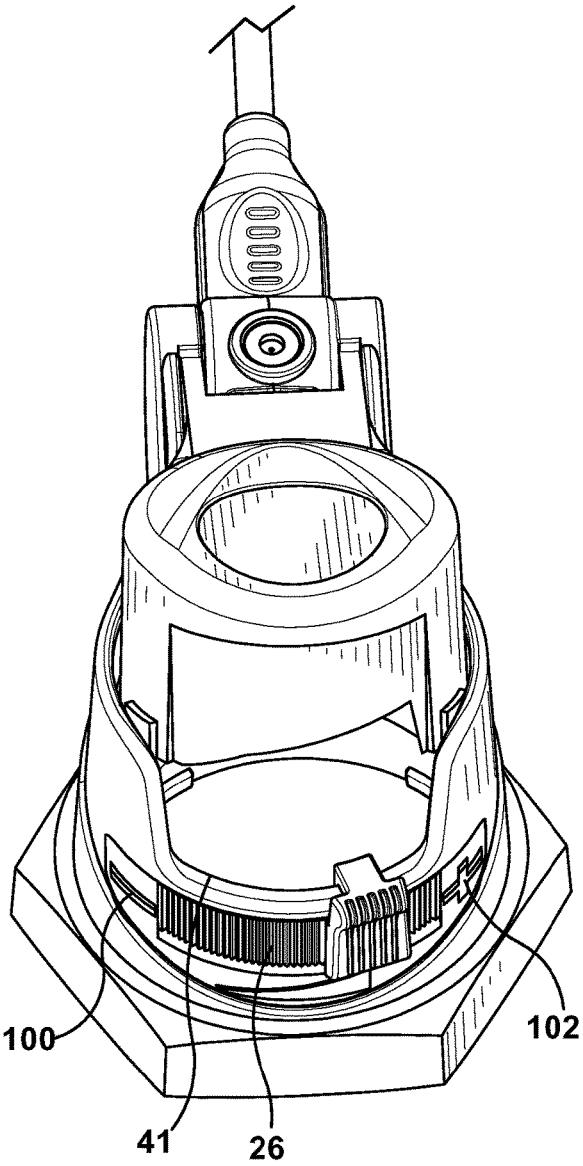
FIG. 7 is an exploded perspective top rear view of the dispensing button partially removed from the housing of the spray can actuator of FIG. 3.

As shown in FIGS. 6 and 7, the sliding tab member 90 is positioned on the housing engaged with the grooves 26 formed for securing the sliding tab member in position along the housing. The button structure 40 is shown with the ramp cut-out 41 positioned adjacent the grooves 26, and for mating engagement with the ramp engaging surface 96 of the sliding tab member 90 along the ramp cut-out. Adjustment of the desired amount of fluid flow F is provided by moving the sliding tab member 90 from the left, or one end of the grooves 26 and ramp cut-out (where low to no volume of fluid flows, as indicated by a minus sign 100, or low flow indicia as in FIG. 2), to the opposite end position along the grooves 26 and ramp cut-out (where the highest volume of fluid flows, as indicated by a plus sign 102, or high flow indicia as in FIGS. 5-6). A further desired flow marking 104 is provided on the housing under the grooves 26, to visually indicate to a user the direction to move the sliding tab member 90 to obtain the desired amount of fluid flow. The flow markings or indicia may be provided raised from the surface of housing or inset into the surface of the housing.

Figure 2:
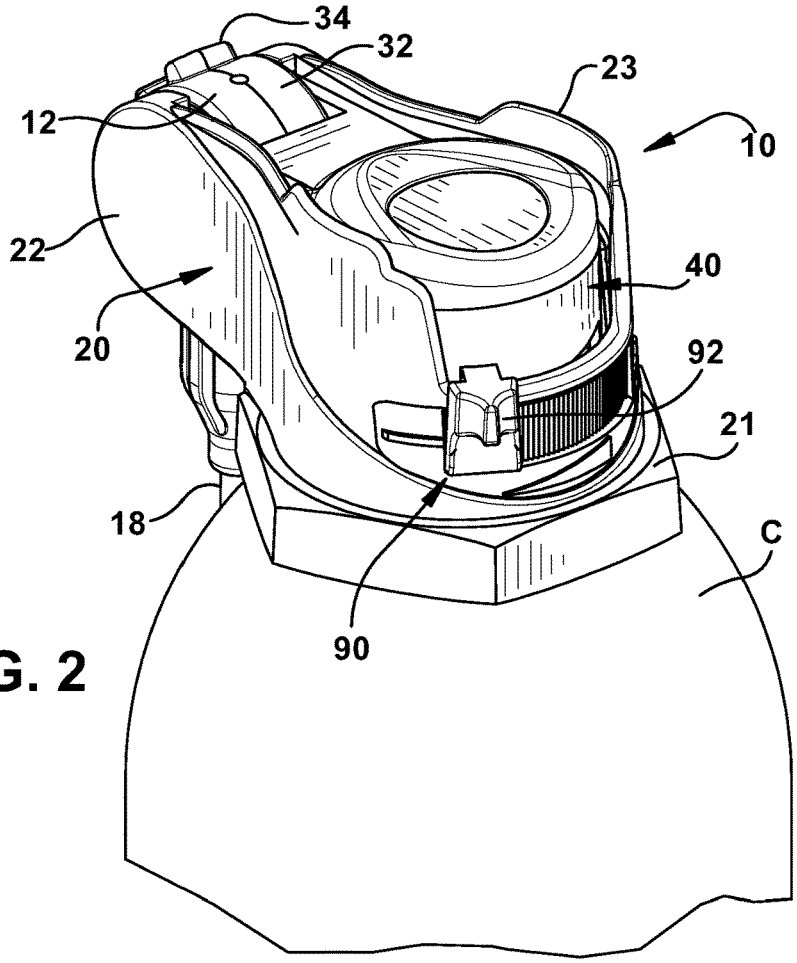
FIG. 2 is a left rear side perspective view of the spray can actuator of this application in straw down position.
Figure 3:
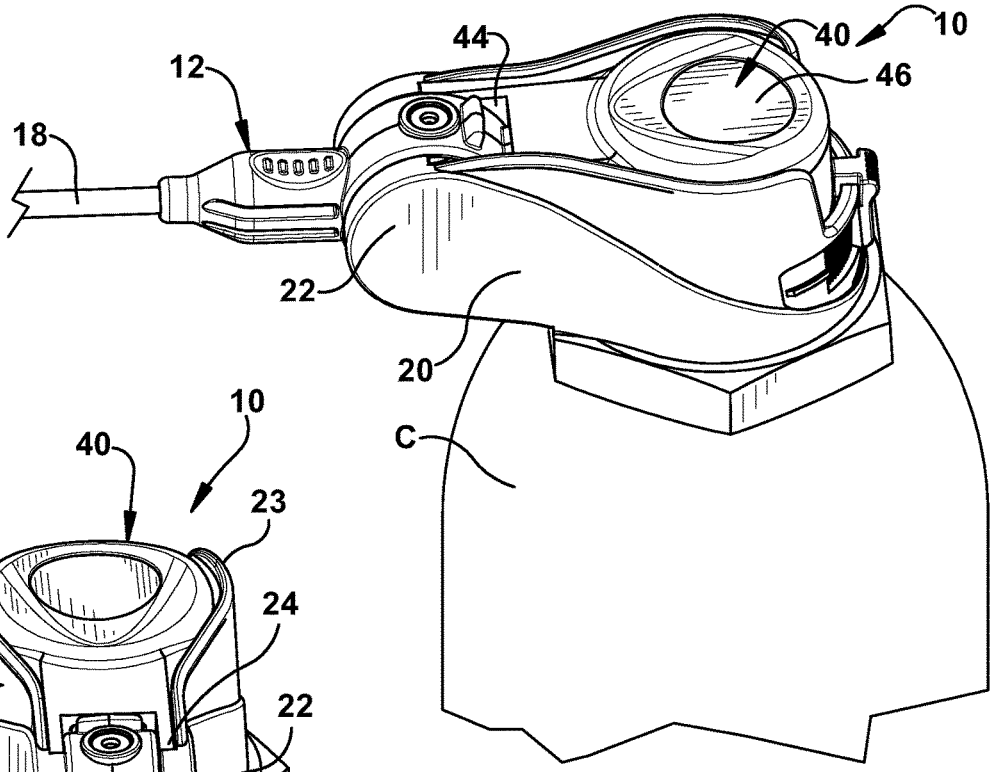
FIG. 3 is a left side perspective view of the spray can actuator of FIG. 1.
Figure 4:
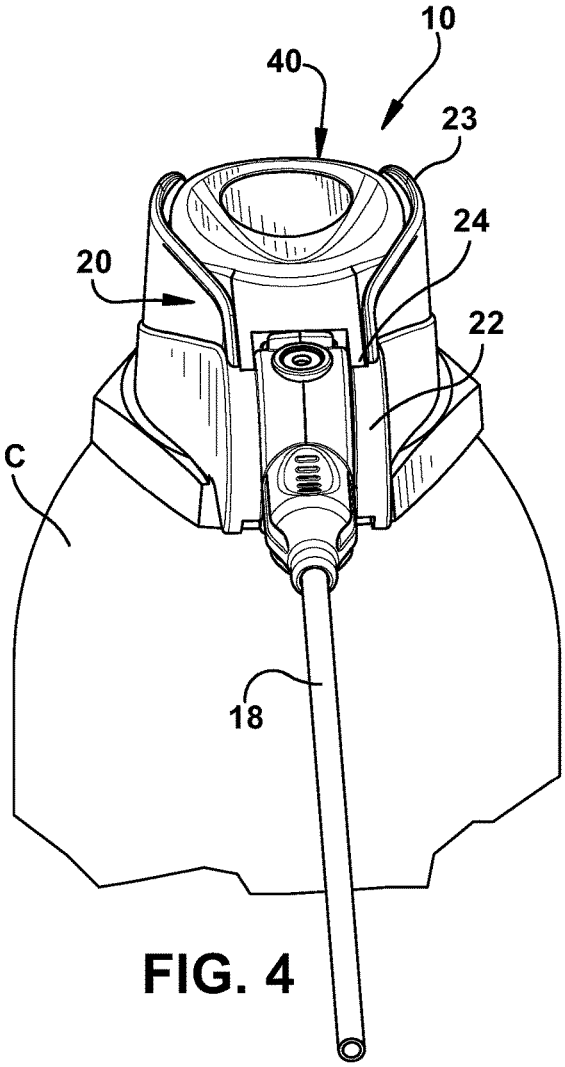
FIG. 4 is a front perspective view of the spray can actuator of FIG. 3.
Figure 5:
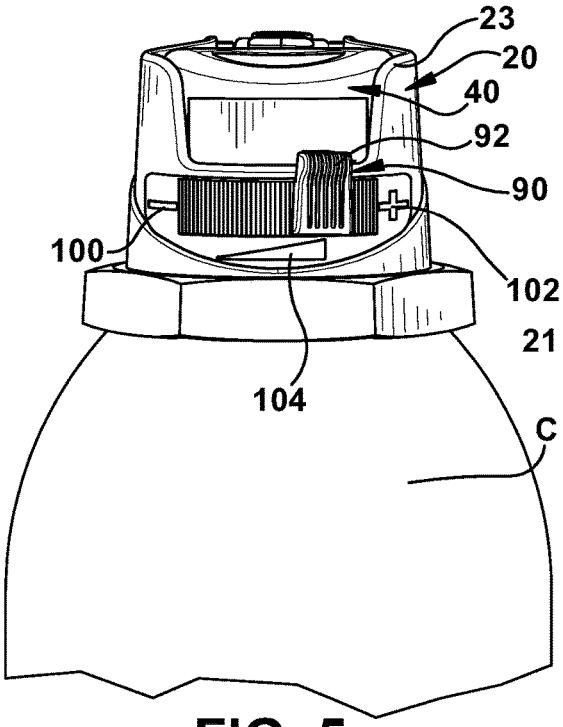
FIG. 5 is a rear view of the spray can actuator of FIG. 3.
Figure 14:
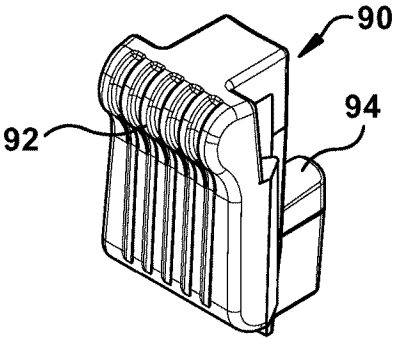
FIG. 14 is a perspective view of the sliding tab member of FIGS. 5 to 7.
Figure 18:
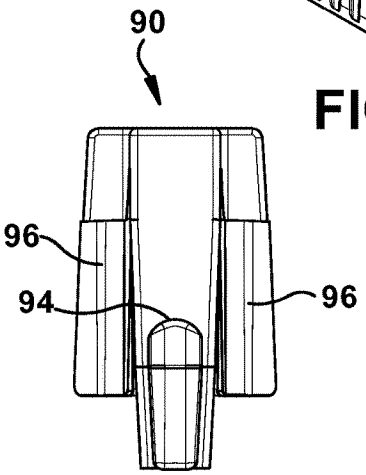
FIG. 18 is a rear view of the sliding tab member of FIG. 14.
Figure 15:
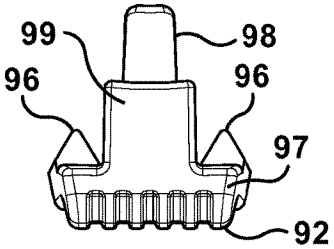
FIG. 15 is a top view of the sliding tab member of FIG. 14.
Figure 19:
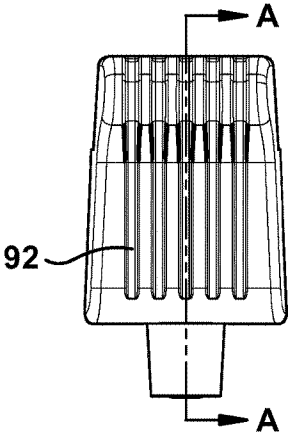
FIG. 19 is a front view of the sliding tab member of FIG. 14.
Figure 16:
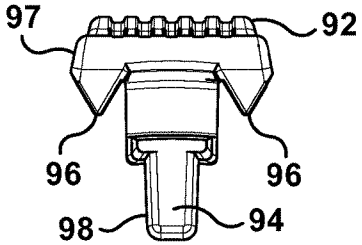
FIG. 16 is a bottom view of the sliding tab member of FIG. 14.
Figure 20:
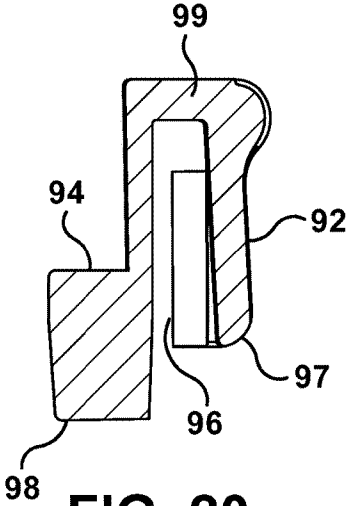
FIG. 20 is a cutaway view of the sliding tab member taken along the line A-A of FIG. 20.
Figure 21:
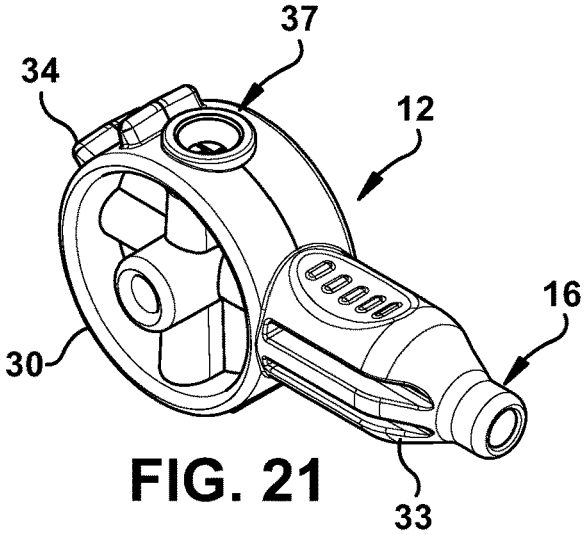
FIG. 21 is a perspective view of the rotary diverter valve of FIGS. 1 to 4.
Figure 23:
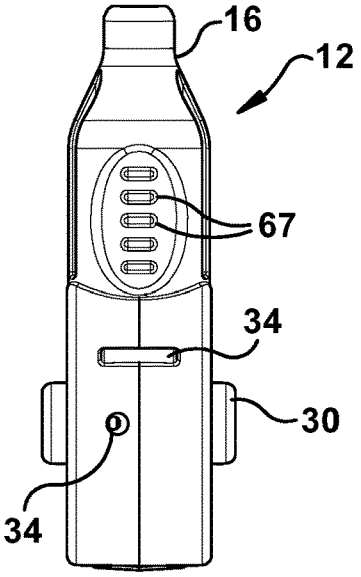
FIG. 23 is a bottom view of the rotary diverter valve of FIG. 21.
Figure 22:
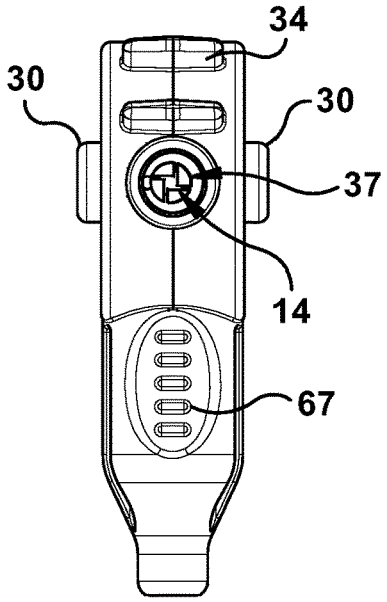
FIG. 22 is a top view of the rotary diverter valve of FIG. 21.
Figure 24:
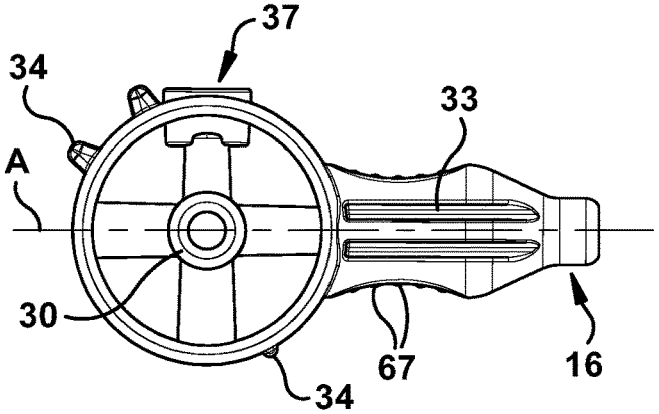
FIG. 24 is a right side view of the rotary diverter valve of FIG. 21.
Figure 25:
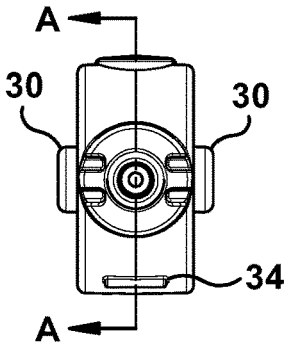
FIG. 25 is a front end view of the rotary diverter valve of FIG. 21.
Figure 26:
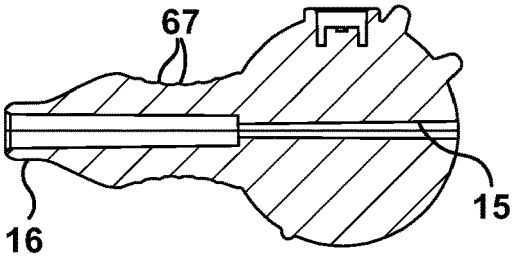
FIG. 26 is a cutaway view of the rotary diverter valve of FIG. 25 taken along the line A-A.
Figure 27:
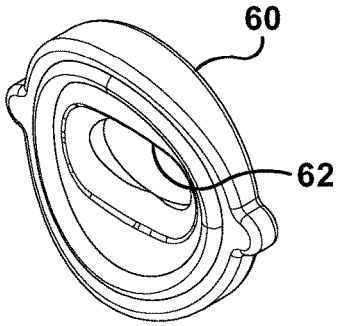
FIG. 27 is a perspective view of a gasket for sealing between the rotary diverter valve and the dispensing button.
Figure 28:
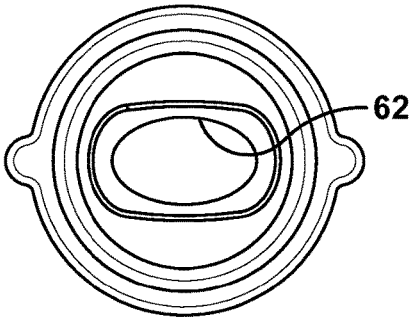
FIG. 28 is a rear view of the gasket of FIG. 27.
Figure 29:
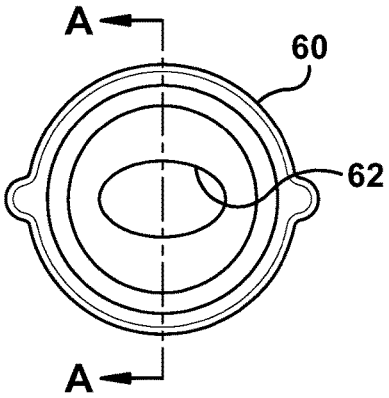
FIG. 29 is a front view of the gasket of FIG. 27.
Figure 30:
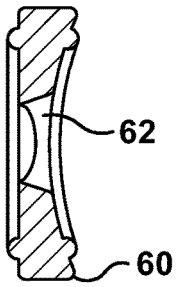
FIG. 30 is a cutaway side view of gasket of FIG. 27 taken along the line A-A of FIG. 29.
Figure 31:
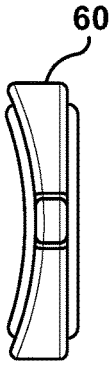
FIG. 31 is a right side view of the gasket of FIG. 27.
Figure 35:
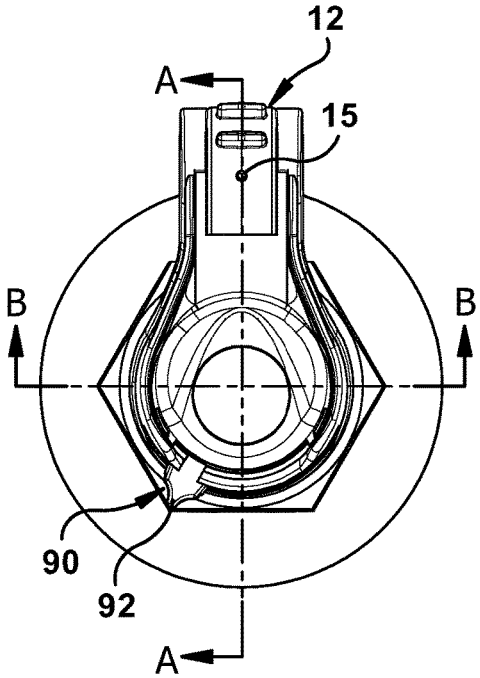
FIG. 35 is a top view of the spray can actuator of FIG. 2 with the rotary diverter valve and straw in the straw down position.
Figure 39:
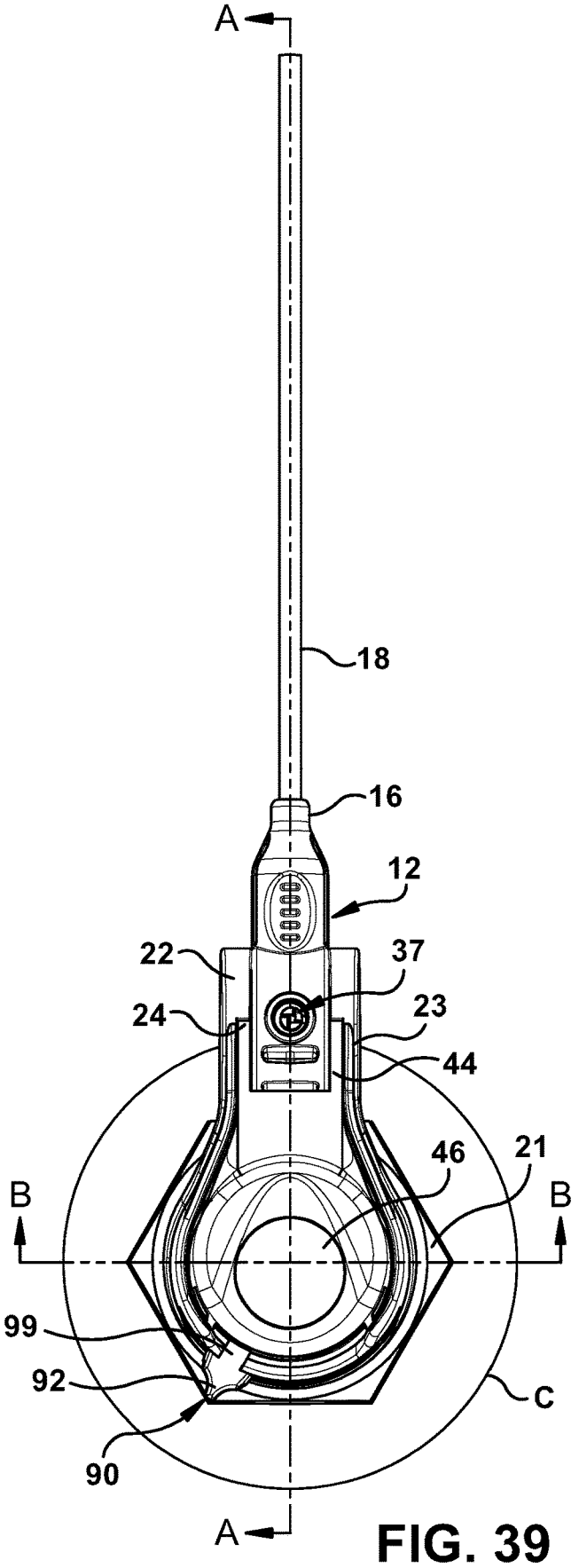
FIG. 39 is a top view of the spray can actuator of FIG. 2 with the rotary diverter valve and straw in the straw up position.

FIGS. 14 to 20 illustrate views of the sliding tab member 90, with the finger operating surface 92 on a surface opposite the teeth 96 all supported on a leg 97, and a leg 98 supporting the ramp engaging surface 94, which extends from the leg in the same direction as the teeth 96. Two spaced teeth 96 are provided on the sliding tab member to ensure the sliding tab member only moves under operation by the user, and not by accidental sliding or by jumping when being moved. The finger operating surface 92 on leg 97 is interconnected with the leg 98 by a web portion 99 which captures and secures the sliding tab member 90 on the housing, and may also provide supporting engagement on the housing. FIGS. 14, 15 and 19 illustrate finger operating surface 92 of the sliding tab member with finger ribs, while FIGS. 2, 35 and 39 illustrate the finger operating surface 92 as a projecting portion directed away from the external surface of the housing which has a substantially V-shaped configuration, as seen from a top view or cross-section, for gripping between a thumb and index finger for sliding engagement by the user for moving the sliding tab member to the right and left. The sliding tab member is preferably manufactured of polyoxymethylene, known as acetal plastic, or other suitable thermoplastic materials appropriate for providing low friction, high stiffness and dimension stability.

Figure 11:
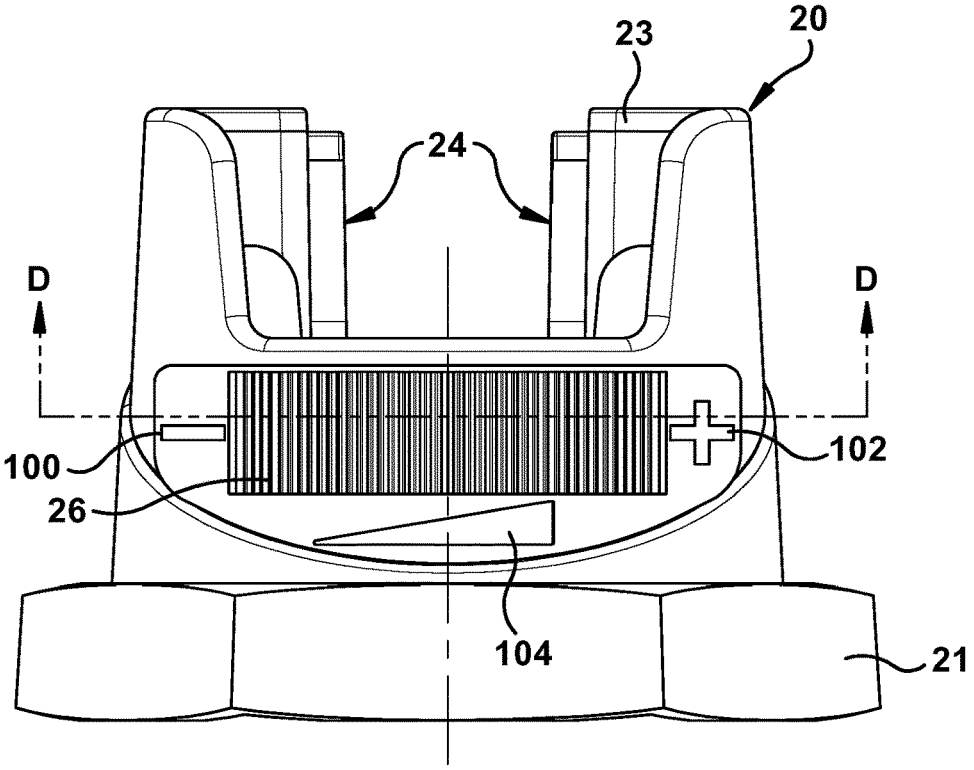
FIG. 11 is a rear view of the housing of FIG. 8B.
Figure 13:
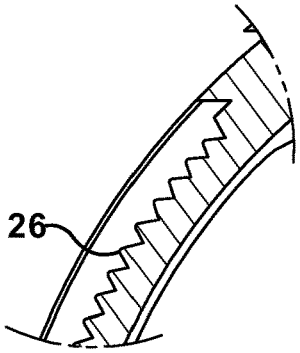
FIG. 13 is an enlarged cutaway view of Section E of the housing of FIG. 12.
Figure 12:
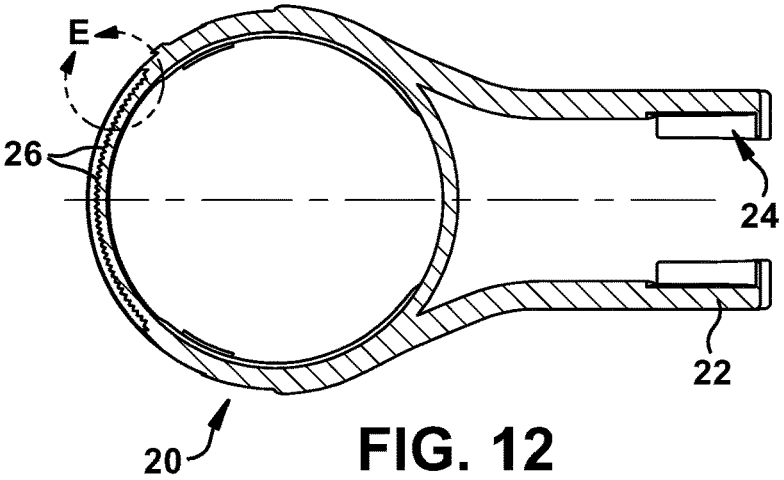
FIG. 12 is a cutaway view of the housing taken along the line D-D of FIG. 11.
Figure 17:
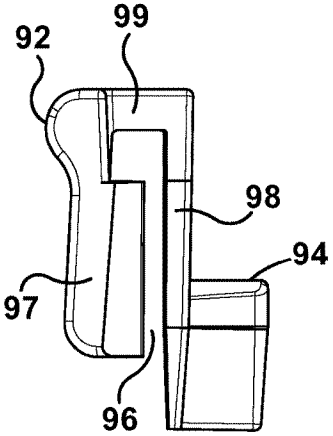
FIG. 17 is a right side view of the sliding tab member of FIG. 14.
Figure 37:
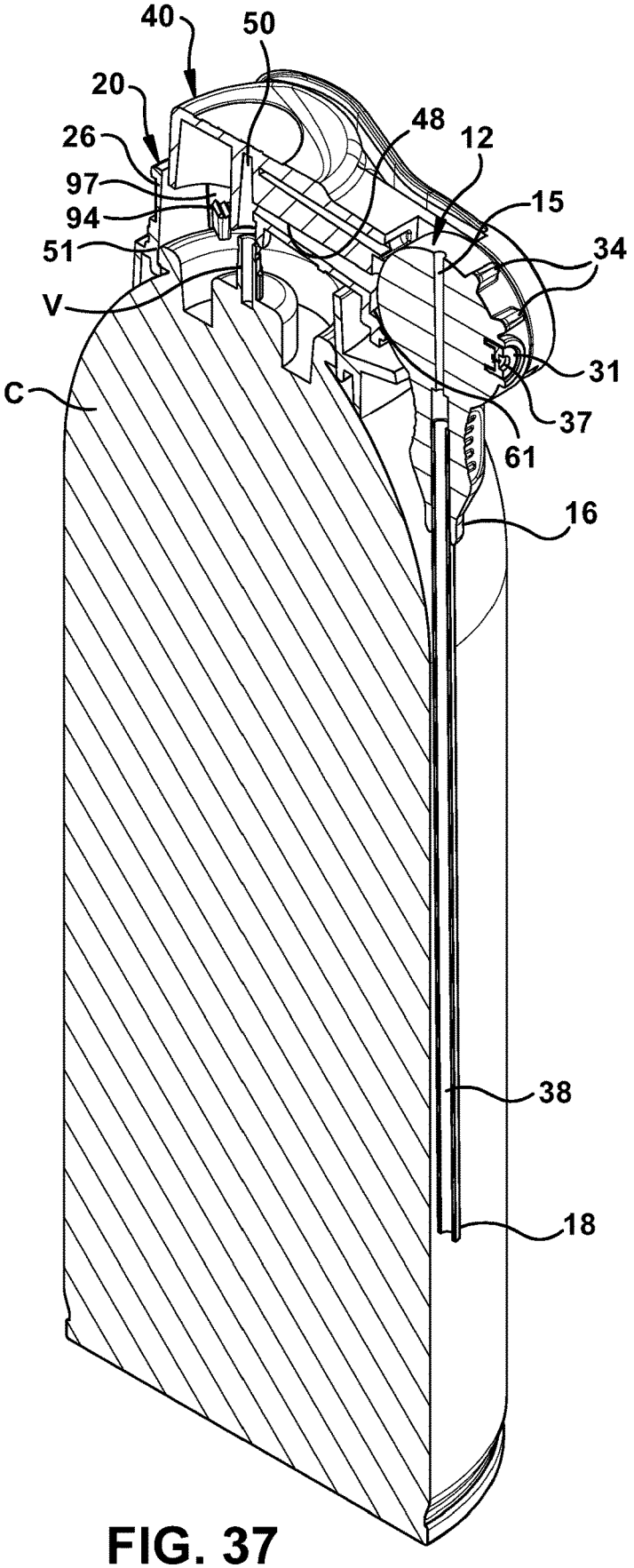
FIG. 37 is a perspective cutaway view of the spray can actuator of FIG. 36.
Figure 38:
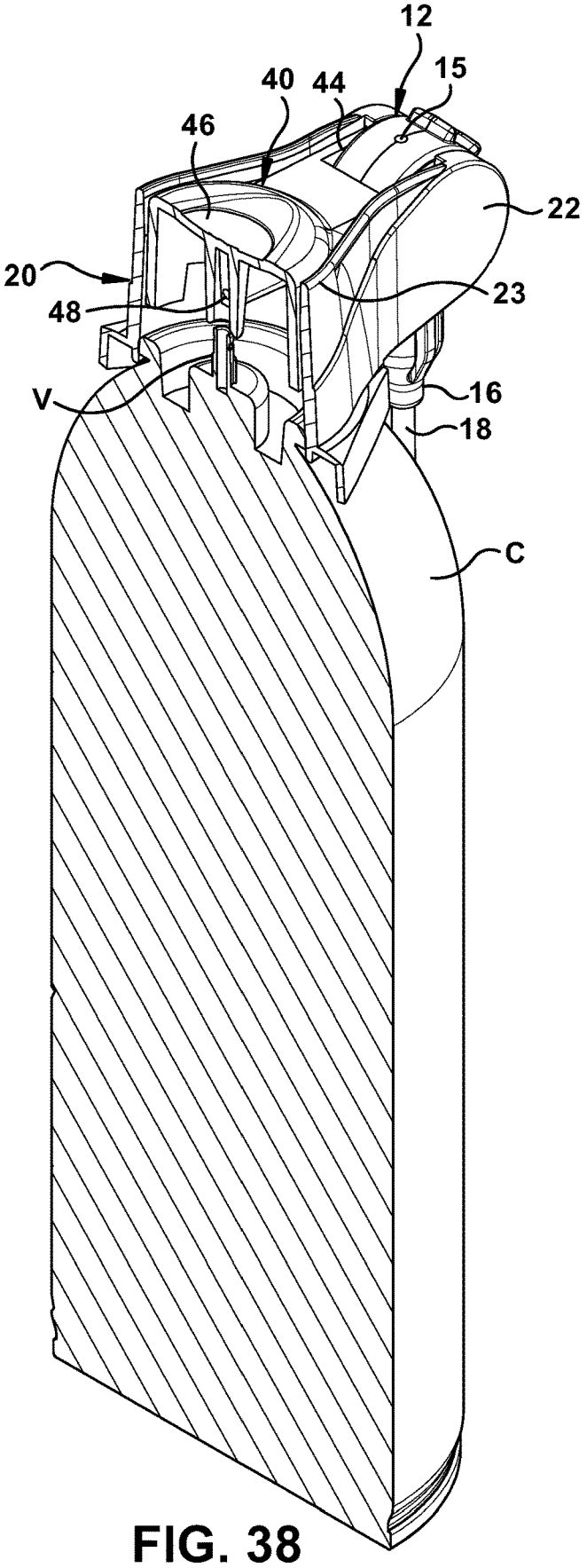
FIG. 38 is a cutaway end view of the spray can actuator of FIG. 35 taken along the line B-B.

During use, a user moves the sliding tab member 90 to the desired position of fluid flow volume to be used, and then downwardly depresses a button 46 of the button structure 40, to release that volume of fluid F from the spray can C via the desired fluid path through the two-way diverter valve (straw up or straw down) selected by the user. Depending on the position of the ramp 94 of the sliding tab member 90 engaged with the ramp cut-out 41 in the button structure, vertical movement of the spray can valve is either more or less depressed to obtained the desired fluid flow. During movement of the sliding tab member 90, essentially moving, by steps or stepping or clicking, by friction engagement of the teeth 96 moving from engagement in one mating groove 26 to the next mating groove to the desired position. FIGS. 11 to 13 illustrate the size and angles of the surfaces of the teeth along the housing. At the same time, the ramp engaging surface 94 likewise moves with friction engagement along the ramp cut-out 41. As shown in FIGS. 17 and 18, the ramp engaging surface 94 has a rounded configuration. However, a ramped toothed surface, as shown in FIG. 37, or mating teeth may also be provided with the button housing structure.

Figure 8A:
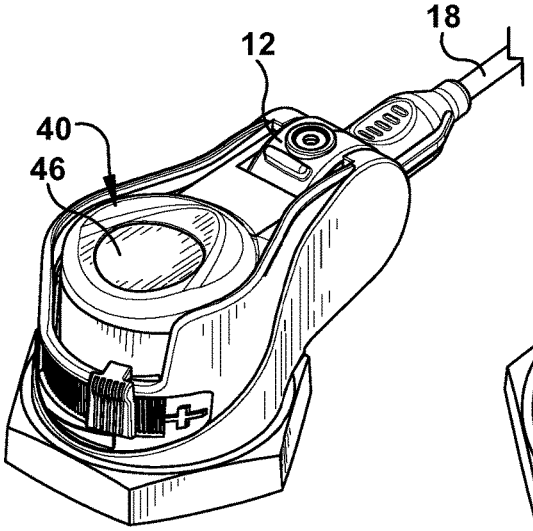
FIG. 8A is a top right side perspective view of the spray can actuator of FIG. 3 removed from the spray can.
Figure 8B:
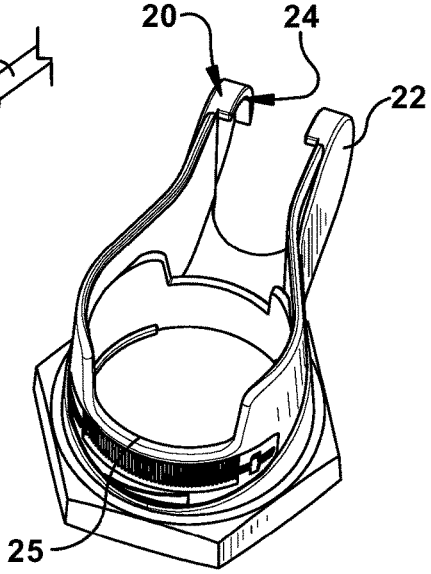
FIG. 8B is a top right side perspective view of the housing of the spray can actuator.
Figure 8C:
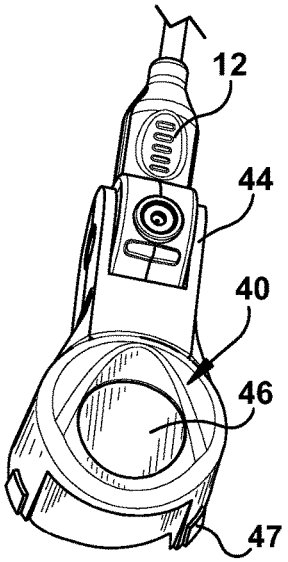
FIG. 8C is a top right side perspective view of the dispensing button and rotary diverter valve of the spray can actuator.
Figure 9:
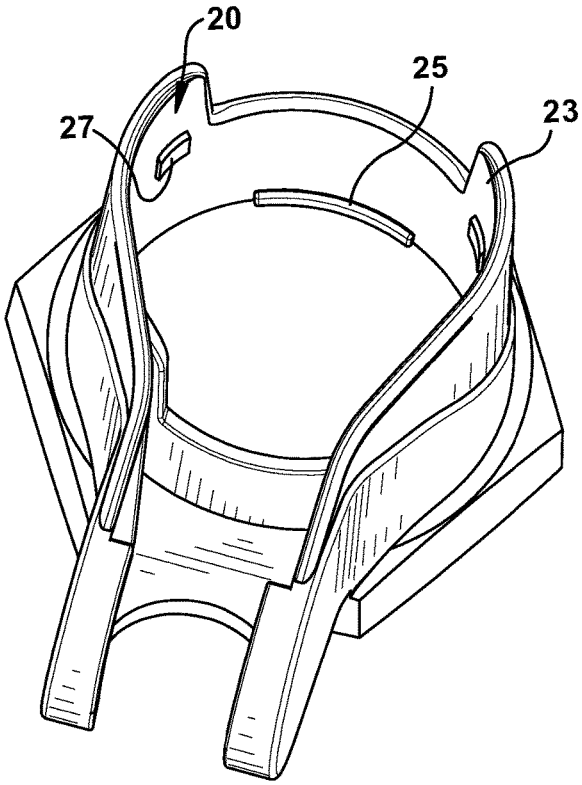
FIG. 9 is an enlarged cutaway top perspective view of the inside of the housing of FIG. 8B.
Figure 10:
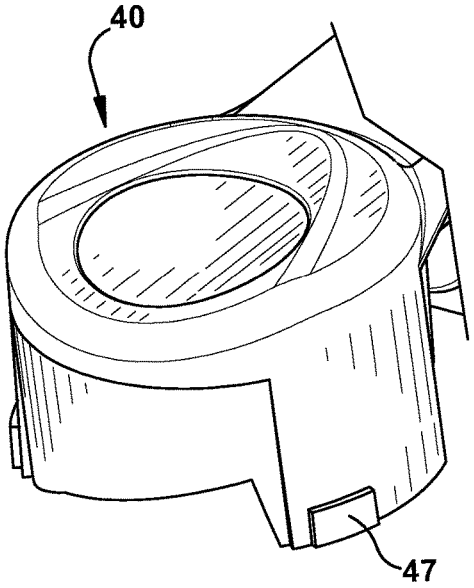
FIG. 10 is an enlarged cutaway left side perspective view of the outside of the dispensing button of FIG. 8C.

FIGS. 8A, 8B and 9 further illustrates the housing 20 for attachment over the aerosol can valve stem V. The housing 20 includes a hex base 21 which is engaged, or snapped, over can C top components T and retained by spaced tabs 25 extending inwardly from the hex base as shown in FIGS. 12-15 and 20-24. Mounting legs 22 extend upward and away from the hex base 21, out of the footprint of the can C, to form an opening 24 for rotating engagement by the diverter valve 12, which is captured within the mounting legs 22 and the finger operating dispensing button structure 40. The button structure 40 is vertically, slidably engaged, and captured within the housing 20 for finger operation by a user of a button 46, which depresses the spray can valve stem V. An integral apron 23 extends upward from the one-piece hex base 21 and mounting legs 22, to substantially surround and extend above the finger operating button structure 40, as illustrated in FIGS. 1-5. The extension of the apron 23 above the surface of the button 46, assists with avoiding accidental depression of the button 46 to spray fluid during storage or shipment of the spray can. Tabs 27, 47 shown in FIGS. 9 and 10 on the inside of the housing and outside of the button structure, respectively, are engaged to maintain the button structure secured within the housing. The housing is preferably manufactured of polyethylene or other equivalent polymer material.

Figure 40:
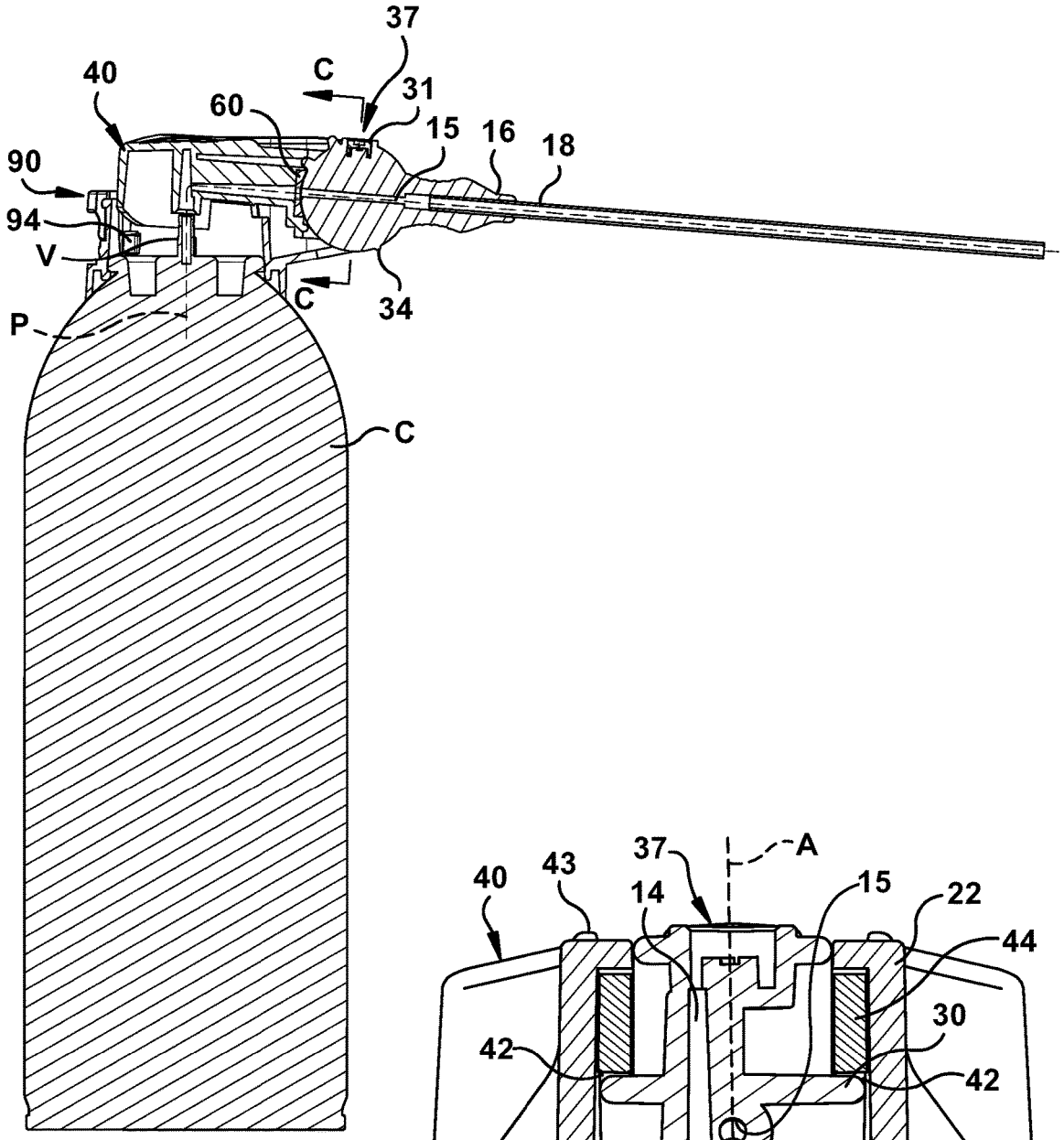
FIG. 40 is a cutaway side view of the spray can actuator of FIG. 39 taken along the line A-A.
Figure 41:
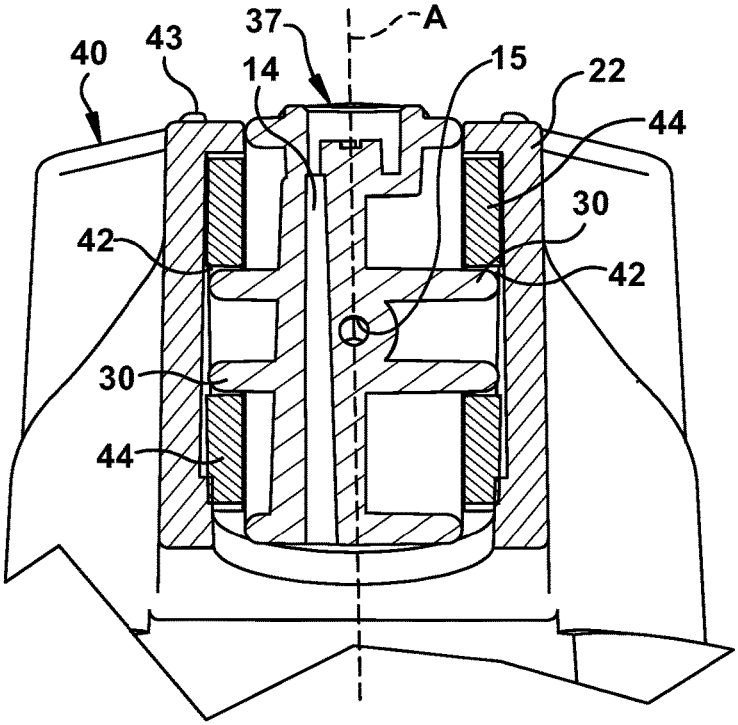
FIG. 41 is a cutaway end view of the rotary diverter valve taken along the line C-C of FIG. 39.
Figure 42:
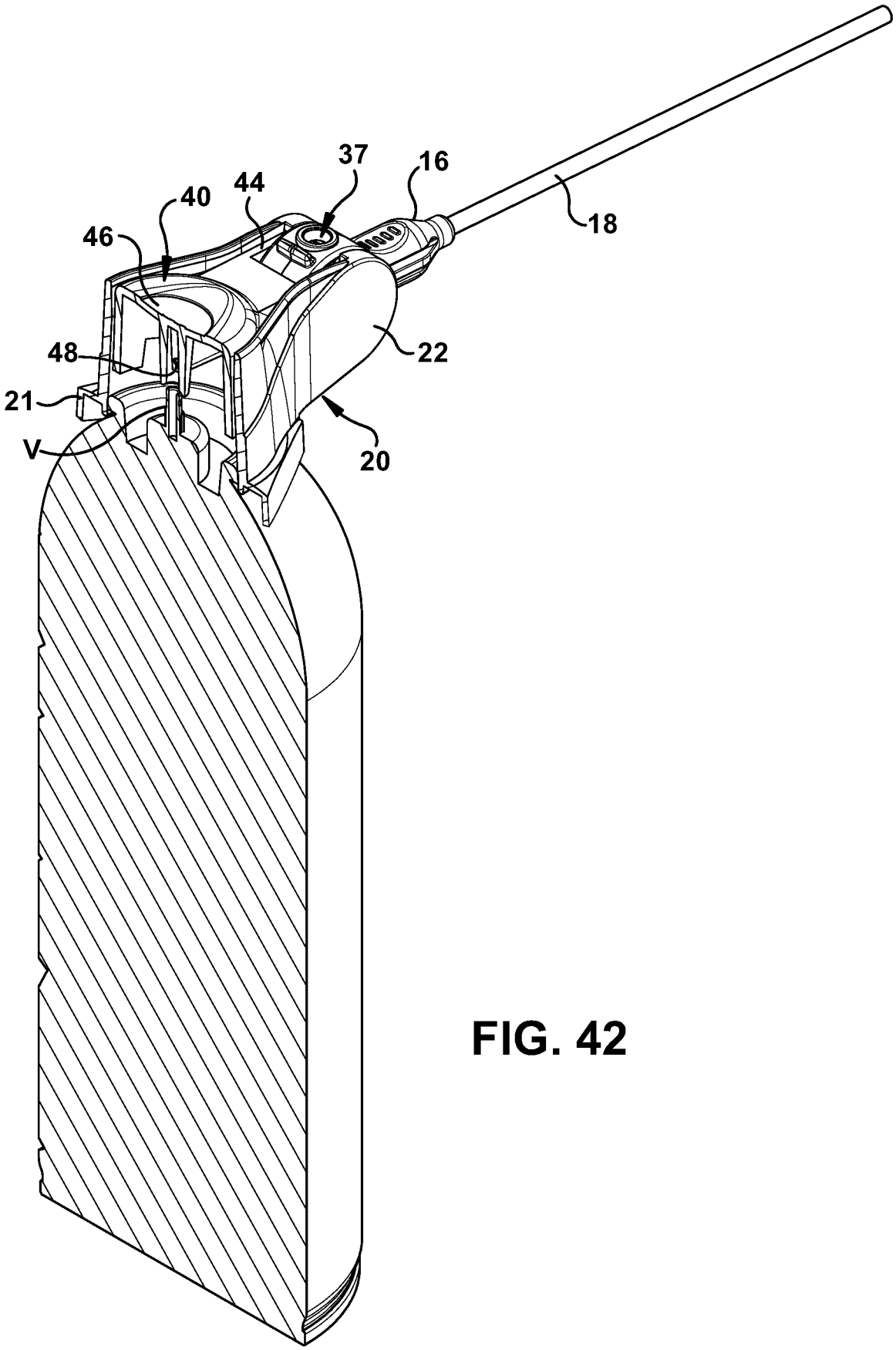
FIG. 42 is a perspective cutaway end view of the spray can actuator of FIG. 39 taken along the line B-B.
Figure 43:
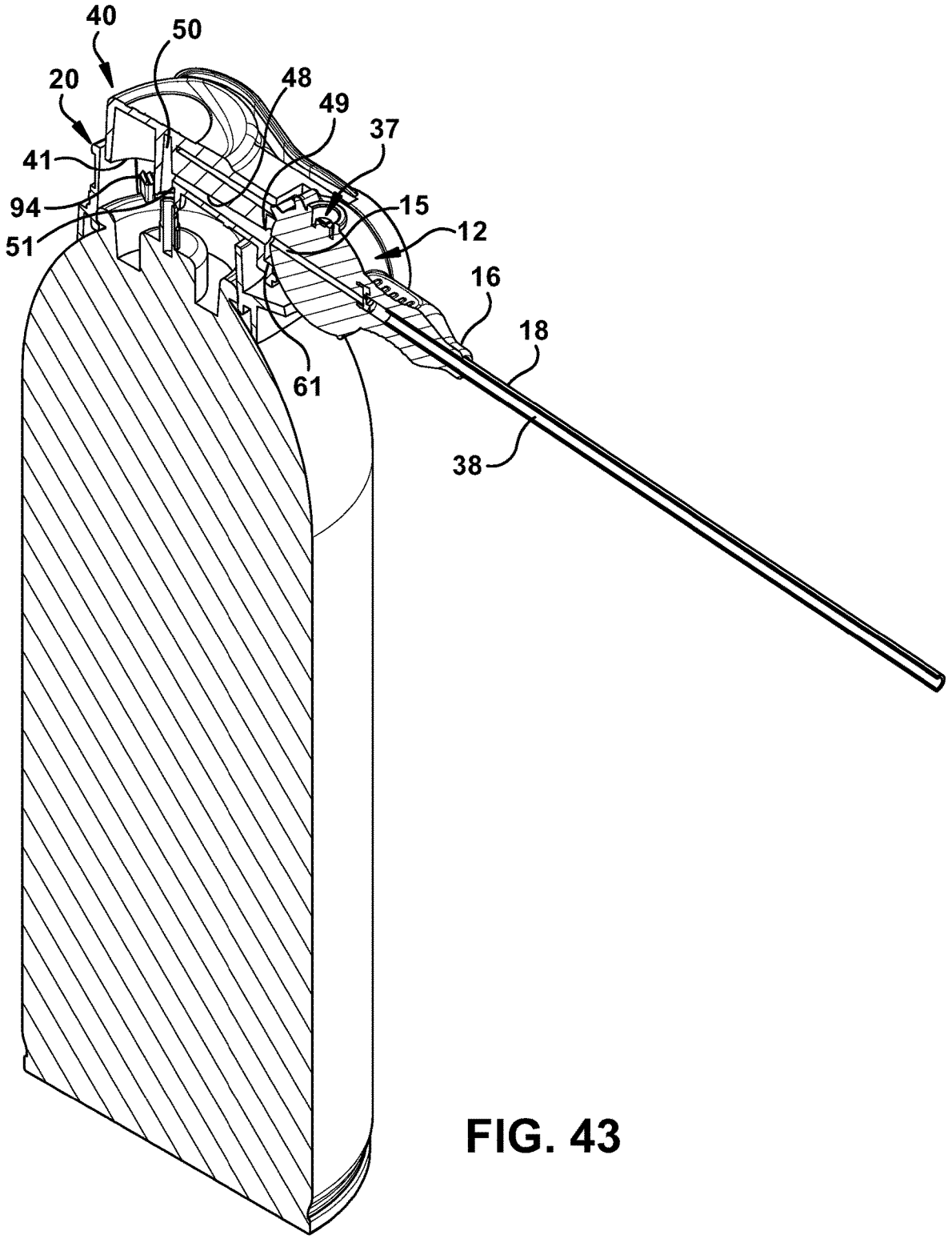
FIG. 43 is a perspective cutaway side view of the spray can actuator of FIG. 39 taken along the line A-A.

The button structure 40 includes an internal nozzle passage 48. In FIGS. 36-38, and 40, 42 the button structure 40 is shown engaged with the can and valve stem V. In FIGS. 36 and 40-41, additional internal aspects of the passages within the button structure 40 are seen. The nozzle passage 48 extends transversely from a central vertical conically shaped passage 50. Within the vertical passage 50, a stop 51 is provided to engage and depress the valve stem V downwardly when a user depresses the button 46 of the button structure 40, to release fluid F from the spray can C in the desired volume selected by the user using the sliding tab member 90. A nozzle end 49 of the nozzle passage 48 is positioned immediately adjacent the rotary diverter valve 12. The diverter valve 12 is engaged with and captured within the button structure 40 and the housing 20 at a gasket 60 having an oval opening 62 for sealing both of the nozzle passages 14, 15, which gasket is seated within a groove 61 in the button structure 40, to form a seal S. The gasket is preferably made of Buna-nitrile, or appropriately equivalent rubber material, with a durometer of approximately 70 A. The button structure 40 is preferably manufactured of polyethylene, high density polyethylene or other equivalent polymer material.

To obtain fluid F from the spray can C, the two-way diverter valve 12 is adapted for rotation by the user to the position where fluid will be dispensed from the desired location of the spray can actuator 10. For the full spray position, the straw is rotated to a down position, as in FIG. 2, for example. For the straw spray position, the straw is rotated to an up position, as in FIG. 1, by rotating the rotary diverter valve 12. For obtaining a stream of fluid from the straw, the sliding tab member 90 is moved or stepped toward the plus indicia 102 on the housing. For obtaining a lesser amount of fluid from the straw, such as a series of drips, the sliding tab member is moved or stepped toward the minus indicia 100 on the housing to the desired volume. In a position fully toward the minus indicia, very little to no fluid may be removed from the can, as the amount obtained depends on the remaining pressure in the can. If there is low pressure in the can, not much fluid will be obtained with the sliding tab member 90 fully toward the minus indicia. The two-way diverter valve 12 is adapted for rotation by the user with one hand or preferably one finger. The diverter valve 12, as well as the flexible straw 18, are preferably manufactured of polypropylene or other equivalent polymer material.

The two-way rotary diverter valve 12 is best illustrated in FIGS. 21 to 26. The diverter valve 12 includes integral boss axles 30. The axles 30 are mounted for rotation within axle openings 42 formed in the mounting legs 44 of the button structure 40, which are captured within the legs 22 and opening 24 of the housing 20. The external surface 32 of the diverter valve 12 is preferably provided with features such as a textured surface, for example the grooves 33 and ribs 34, or protruding features such as ribs, or raised portions ("nibs") 67 in FIGS. 24 and 26. These surface features assist the user to overcome the finger force required to rotate the diverter valve 12 while maintaining the seal S, provided by the gasket 60 between the diverter valve 12 and the button structure 40.

Figure 32:
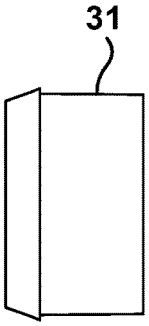
FIG. 32 is a side view of the spray tip for the rotary diverter valve.
Figure 33:
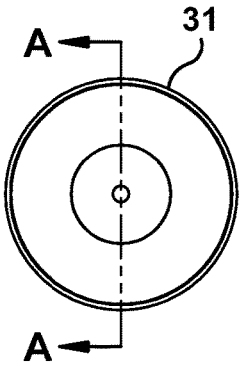
FIG. 33 is a front view of the spray tip FIG. 32.
Figure 34:
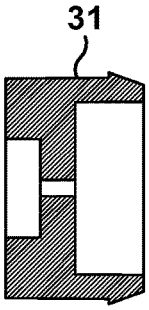
FIG. 34 is a cutaway view of the spray tip of FIG. 33 taken along the line A-A.

Following the fluid path exiting the spray can C in spray position/straw down (FIGS. 36-37): As the button 46 is depressed, and the valve stem V engages the stop 51, fluid F exits the can via the valve stem to the central vertical conical passage 50, to nozzle passage 48 past nozzle end 49 and the gasket 60, within groove 61, into the nozzle 14 and an exit nozzle 37 in the diverter valve 12. Nozzle 14 is offset from central axis A, as shown in FIG. 41, while nozzle 15 is substantially aligned with central axis A. A spray tip 31, illustrated in FIGS. 32 to 34, is engaged, by a snap fit or press fit, into engagement over the exit nozzle 37, as shown in FIGS. 36-37. The spray tip is preferably manufactured of polyoxymethylene such as acetal plastic, or other suitable thermoplastic materials appropriate for providing low friction, high stiffness and dimension stability.

Following the fluid path exiting the spray can C in straw up position, the two-way diverter valve 16 is rotated upward until a nib 34 engages an opening in the button structure 40, as shown in FIG. 40, to stop movement of the valve 12. In this position, the fluid path is blocked from the nozzle 14. Instead, once the button 46 is depressed, fluid exits the can C via the valve stem V, vertical conical passage 50 and nozzle passage 48, past the gasket 60 and groove 61, to the straw nozzle 15 and in fluid communication with the spray tip 16 to a straw passage 38 in straw 18, which is press fit or otherwise secured with the spray tip 16.

Although the spray can actuator of the present application has been described in detail sufficient for one of ordinary skill in the art to practice the invention, it should be understood that various changes, substitutions and alterations may be made without departing from the spirit or scope of the device as defined in the attached claims. Moreover, the scope of the present device is not intended to be limited to the specific embodiments described here, which are provided by way of example. As one of ordinary skill in the art will readily appreciate from the disclosure of the present device and its embodiments, other components and means presently existing or later to be developed that perform substantially the same function to achieve substantially the same result as those of the corresponding embodiments described here, may be utilized according to the present application. Accordingly, the appended claims are intended to include within their scope such other components or means.

We claim:

1. An actuator for a spray can, the actuator comprising a housing for attachment to a spray can covering a spray can stem valve, a finger operating button structure engaged with the housing for engaging the stem valve, a rotary two-way diverter valve supported within the housing and engaged with the finger operating button structure, the two-way diverter valve having a first direct spray nozzle, offset from a central axis of the two-way diverter valve, and a second nozzle, aligned with the central axis of the two-way diverter valve and in communication with a straw engaged with the diverter valve adjacent the second nozzle, and a sliding member engaged intermediate the housing and finger operating button structure for selectively changing the volume of fluid dispensed from the diverter valve nozzles by movement of the sliding member to limit or permit engagement of the button structure with the stem valve between different volumes of fluid.

2. The actuator for a spray can of claim 1, wherein the finger operating button structure includes a conical nozzle passage for engagement with the stem valve, and a nozzle passage extending horizontally from the conical nozzle passage to a nozzle end, surrounded by a groove for seating a gasket having a smaller opening for surrounding both the first direct spray nozzle and the second nozzle on an external surface of the two-way diverter valve to form a seal with either nozzle.

3. The actuator for a spray can of claim 2, wherein the two-way diverter valve includes boss axles, extending from opposing sides of the diverter valve for captured, rotary engagement of the two-way diverter valve with the finger operating button structure.

4. The actuator for a spray can of claim 3, wherein the two-way diverter valve has raised ribs extending from an external surface for blocking rotation of the diverter valve.

5. The actuator for a spray can of claim 1, wherein the housing includes indicia indicating a location for positioning the sliding member to obtain more volume of fluid from the spray can, and indicia indicating a location for positioning the sliding member to obtain less to no volume of fluid from the spray can.

6. An adjustable actuator for a spray can, the actuator comprising a housing for attachment to a spray can covering a spray can stem valve, a finger operating button structure with a ramp cut-out portion, and the button structure is engaged with the housing for engaging the stem valve, a sliding tab member is engaged on the housing and includes a ramp surface for engagement with the ramp cut-out portion for selecting the volume of fluid to be dispensed from the spray can based upon the position of the sliding tab member with respect to the button structure, and a one-piece two-way diverter valve supported within the housing is engaged with the finger operating button structure, the one-piece two-way diverter valve includes a first direct spray nozzle and a second nozzle, which nozzles are positioned transverse with respect to one another and each is positioned for communication with a spray tip formed in the two-way diverter valve, the first direct spray nozzle spray tip provides a fan spray of fluid, and the second nozzle spray tip includes a straw for directing fluid to a spaced location from the spray can, and wherein positioning of the sliding tab member enables directing fluid through the nozzles and spray tips in a spray or stream of fluid or in drops of fluid.

7. The adjustable actuator of claim 6, wherein the housing includes grooves or teeth on an external surface for engagement with the sliding tab member.

8. The adjustable actuator of claim 7, wherein the external surface of the housing further includes a high volume indicia indicating a location for positioning of the sliding tab member for receiving a high volume of fluid from the spray can, and the external surface of the housing includes a low volume indicia, spaced from the high volume indicia, indicating a location for positioning of the sliding tab member for receiving a low volume of fluid from the spray can.

9. The adjustable actuator of claim 8, wherein the sliding tab member includes a pair of spaced teeth for mating engagement within grooves formed on the external surface of the housing.

10. The adjustable actuator of claim 9, wherein the sliding tab member includes a first leg supporting the spaced teeth and a finger surface on a surface opposite the spaced teeth to enable a user to move the teeth of the sliding tab member along the mating housing grooves, and a second leg supporting the ramp engaging surface which engages the ramp cut-out on the button structure, and a web portion interconnecting the first and second legs.

11. The adjustable actuator of claim 10, wherein the finger surface on the first leg of the sliding tab member has a projecting portion directed away from the external surface of the housing and has a V-shaped configuration in cross-section.

12. An adjustable actuator for a spray can having a movable tab member adapted for incremental movement on a housing secured to the spray can to select a desired volume of fluid from the spray can between a low to no volume of fluid flow, and a high volume of fluid flow, wherein the movable tab member includes a leg supporting teeth for engagement with the housing, a second leg interconnected with the teeth supporting leg by a web portion, the second leg having a surface for engagement with a button structure within the housing, a finger surface to enable a user to move the tab member horizontally along the housing, and wherein the adjustable actuator includes markings or indicia indicating positions for the movable tab member where lower fluid flow volumes are dispensed and positions where higher fluid flow volumes are dispensed.

13. The adjustable actuator for a spray can of claim 12 wherein the second leg, interconnected with the teeth supporting leg includes a ramp engaging surface for sliding engagement with a ramp cut-out portion on the button structure secured within the housing for operating the spray can.

14. An adjustable actuator for a spray can, the actuator comprising a housing for attachment to a spray can covering a spray can stem valve, a finger operating button structure with a cut-out portion, and the finger operating button structure is engaged with the housing for engaging the stem valve, a tab member is engaged on the housing and includes a surface for engagement with the cut-out portion for selecting a volume of fluid to be dispensed from the spray can based upon a position of the tab member with respect to the button structure, and a two-way diverter valve supported within the housing is engaged with the finger operating button structure, the two-way diverter valve includes a direct spray nozzle and a second nozzle, which nozzles are positioned transverse with respect to one another and each is positioned for communication with a spray tip.

15. The adjustable actuator for a spray can of claim 14, wherein the direct spray nozzle spray tip provides a spray of fluid, and the second nozzle spray tip includes a straw for directing fluid to a spaced location from the spray can.

16. The adjustable actuator for a spray can of claim 15, wherein selective user positioning of the tab member enables directing fluid through the nozzles and spray tips in a desired spray or stream of fluid or in desired drops of fluid.

17. The adjustable actuator of claim 14, wherein an external surface of the housing further includes a high volume indicia indicating locations for positioning of the tab member for receiving a high volume of fluid from the spray can, and the external surface of the housing includes a low volume indicia, spaced from the high volume indicia, indicating locations for positioning of the tab member for receiving a low volume of fluid from the spray can.

18. The adjustable actuator of claim 14, wherein the housing includes grooves or teeth on an external surface for mating engagement with the tab member.

* * * * *